US006442871B2

(12) United States Patent
Doerer et al.

(10) Patent No.: US 6,442,871 B2
(45) Date of Patent: Sep. 3, 2002

(54) SHOE HEEL

(75) Inventors: Daniel M. Doerer, St. Louis, MO (US); Patricia S. Brown, Madison, IL (US); David H. Schwarz, St. Louis, MO (US)

(73) Assignee: Brown Shoe Co., Clayton, MO (US)

( * ) Notice: Subject to any disclaimer, the term of this patent is extended or adjusted under 35 U.S.C. 154(b) by 0 days.

(21) Appl. No.: 09/865,221

(22) Filed: May 25, 2001

Related U.S. Application Data

(63) Continuation-in-part of application No. 09/352,645, filed on Jun. 28, 1999, now abandoned.

(51) Int. Cl.[7] ..... A43B 21/26; A43B 21/36

(52) U.S. Cl. ..... 36/35 R; 36/36 R; 36/36 B; 36/42

(58) Field of Search ..... 36/35 R, 36 R, 36/36 B, 35 A, 42, 34 A, 27

(56) References Cited

U.S. PATENT DOCUMENTS

RE18,959 E * 9/1933 Jorgensen ..... 36/35 R

FOREIGN PATENT DOCUMENTS

EP 269988 * 11/1987 ..... 36/35 R

* cited by examiner

*Primary Examiner*—Anthony D. Stashick
(74) *Attorney, Agent, or Firm*—Polster, Lieder, Woodruff & Lucchesi

(57) ABSTRACT

A shoe heel includes a rigid heel block that attaches to a shoe sole at the heel seat on the sole and a top lift having a molded base that is located below the heel block such that a space exists between the bottom of the block and the top of the base. This space, along the peripheries of the block and base, contains' a highly resilient skirt, the interior of which is for the most part a void. An elastomeric slug projects from the heel block, through the space, and at its lower end bears against the base of the top lift. The slug, while being resilient, possesses enough firmness to support the weight of an individual over the base of the top lift. The top lift contains pins which project from its base into bores in the heel block to prevent the top lift from rotating under the heel block. The slug, while transferring the weight of the individual to the top lift, attenuates impacts to which the top lift is subjected.

26 Claims, 2 Drawing Sheets

SHOE HEEL

CROSS-REFERENCE TO RELATED APPLICATIONS

This application is a continuation-in-part of application Ser. No. 09/352,645, filed Jun. 28, 1999 now abandoned May 31, 2001, and which is incorporated herein by reference.

STATEMENT REGARDING FEDERALLY SPONSORED RESEARCH OR DEVELOPMENT

Not Applicable.

BACKGROUND OF THE INVENTION

This invention relates in general to footwear, and more particularly to a shoe heel that has the capacity to attenuate impacts encountered in walking or running.

An individual's normal act of walking—and even more so running—produces impacts that are transmitted primarily to the heel of the individual's foot, either directly when the individual walks or runs without shoes or indirectly when the individual wears shoes. Some shoes, such as sneakers, have outsoles and insoles which are molded from elastomers, and are thus capable of reducing the severity of the impacts. Indeed, some soles for sneakers have air bladders which even more effectively absorb impacts. But the traditional dress or casual shoe worn by women has a rigid heel with a thin sock lining over the heel seat at the upper end of the heel. Impacts transfer with little attenuation through the heel, heel seat and lining to the heel of the individual's foot, and can cause discomfort, particularly after long periods of walking or standing on hard surfaces.

To be sure, others have undertaken efforts to incorporate shock-absorbing devices into the heels of dress and casual shoes, but for the most part these efforts have not met with success. Some of these devices cannot withstand the impacts themselves. Others are too complex and cost too much to manufacture. The typical dress or casual shoe continues to have a solid heel which transmits impacts to the wearer's heel with little or no attenuation.

BRIEF SUMMARY OF THE INVENTION

The present invention resides in a shoe heel having a rigid block and a top lift which is coupled to the block such that the block may be depressed toward the top lift under moderate force, whereby impacts that would otherwise be transmitted to the heel of the wearer's foot are to a large measure absorbed in the heel. To this end, the heel block contains a slug of resilient material which projects from it and bears against the upper surface of the top lift. Being resilient the slug absorbs impacts.

DETAILED DESCRIPTION OF THE INVENTION

Figure 1:
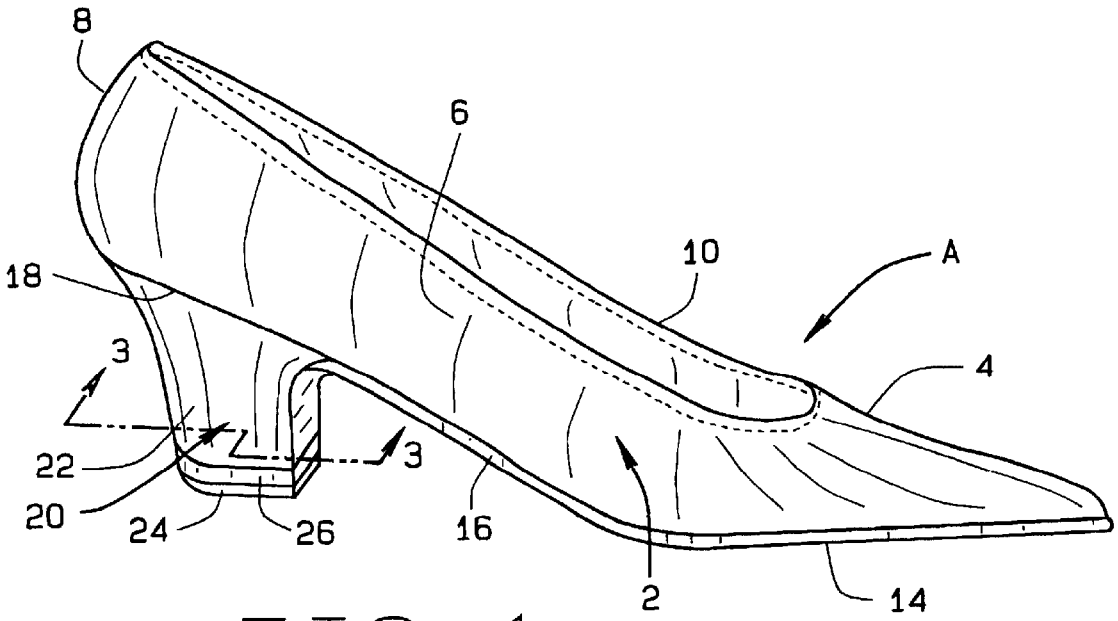
FIG. 1 is a perspective view of a shoe having a heel constructed in accordance with and embodying the present invention.

Referring now to the drawings, a dress or casual shoe A (FIG. 1) has an upper 2, which generally conforms to the shape of the user's foot and has the usual vamp 4 at its forepart, quarters 6 along its sides, a counter 8 at its rear and a top line 10 which provides an opening through which the wearer's foot is inserted. The shoe A also has a sole 14 to which the upper 2 is attached such that the sole 14 underlies the upper 2. Beneath the vamp 4 of the upper 2 the sole 14 contacts the surface upon which the wearer walks, but the sole 14 also includes a shank 16 and heel seat 18 which are elevated from that surface, the heel seat 18 lying at the rear of the upper 2 in the region of its counter 8 and the shank 16 being immediately ahead of it beneath the quarters 6. Finally, the shoe A has a heel 20 which is attached to the sole 14 at its heel seat 18 and indeed underlies the heel seat 18.

Figure 2:
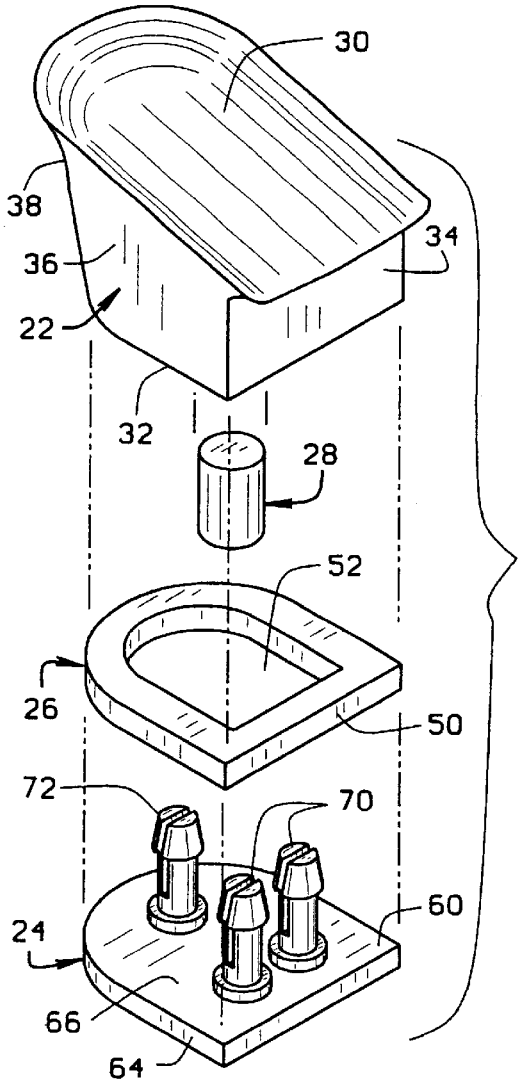
FIG. 2 is an exploded perspective view of the heel.

The heel 20 basically includes (FIGS. 1, 2 and 3) a rigid heel block 22, a top lift 24 located beneath the heel block 22, and a decorative resilient skirt 26 located between the heel block 22 and the top lift 24. In addition, the heel 20 has a slug 28 of resilient material (such as an elastomer) which extends from within the heel block 22 to the top surface of the top lift 24 and is firm enough to support the heel block 22 on the top lift 24 under the weight of the wearer. Yet the slug 28 is resilient enough to deform in the presence of impacts, so that impacts are attenuated through the slug 28. The top lift 24, like the forepart of the sole 14, contacts the surface over which the wearer walks. It possesses some flexibility and extends fore and aft of the slug 28 so that it can flex toward the heel block 22 ahead of and behind the slug 28.

The heel block 22 is formed from a rigid substance, preferably a molded polymer. It has (FIGS. 2 and 3) a top surface 30 which is contoured to conform to the bottom surface of the heel seat 18 for the sole 14. Here the heel 20 is attached firmly to the heel seat 18. The heel block 22 also has a flat bottom surface 32, a front-surface or breast 34, and side and back surfaces 36 and 38. Generally midway between its breast 34 and back surface 38, the heel block 22 contains a bore 40 (FIG. 3) which opens out of the bottom surface 32, but is closed at its top. The axis of the bore 40 lies perpendicular to the bottom surface 32 of the heel block 22. The bore 40 forms a cavity that is large enough to accommodate the slug 28, and indeed the slug 28 fits into the bore 40 with its upper end against the top surface of the bore 40. But the slug 28 is longer than the bore 40, so that its lower end lies below the bottom surface 32 of heel block 22.

In front of the bore 40, the heel block 22 contains two guide bores 42 (FIG. 3), and to the rear of the bore 40, the block 22 contains a single guide bore 44. The guide bores 42 and 44 have their axes parallel to the common axis of the bore 40, but they are considerably smaller in diameter. Each opens out of the bottom surface 32 of the heel block 22 at its lower end and into a counterbore 46 at its upper end, there being a shoulder 48 between each bore 42, 44 and its counterbore 46.

Figure 4:
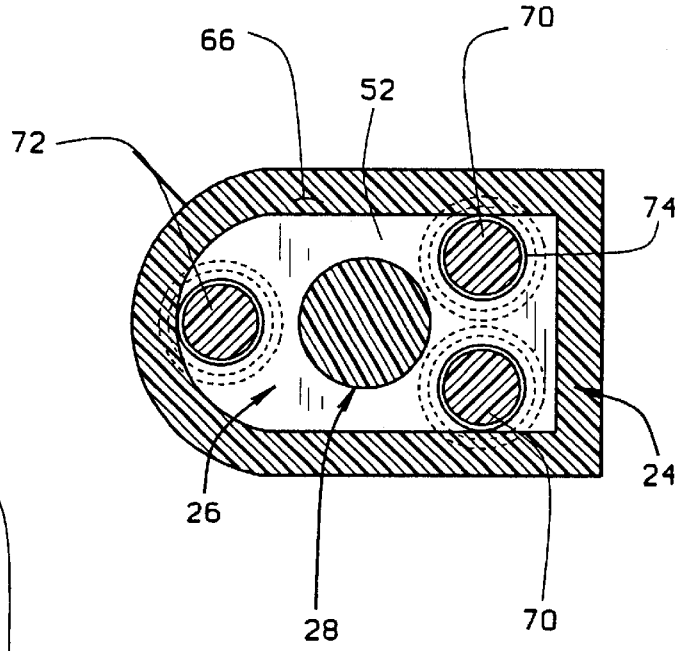
FIG. 4 is a sectional view taken along line 4—4 of FIG. 3.
Figure 5:
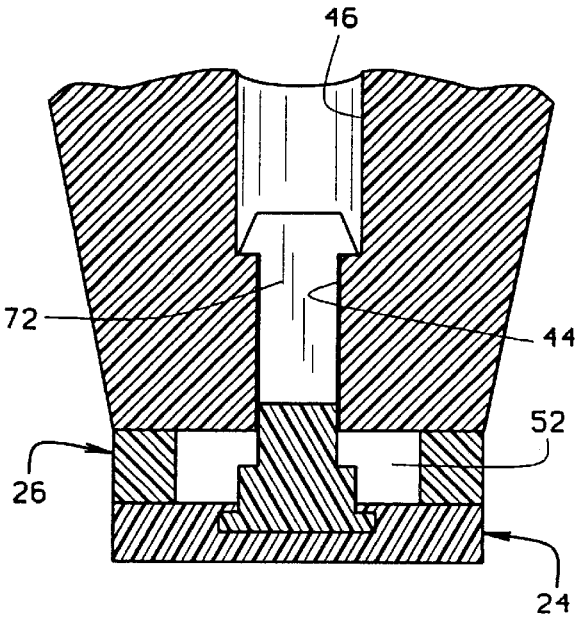
FIG. 5 is a sectional view taken along line 5—5 of FIG. 3

The decorative resilient skirt 26 is formed from a highly flexible, low density, cellular material that provides substantially no shock attenuation. The skirt 26 has (FIGS. 2 and 4) a smooth exterior surface 50 and an elongated internal cavity 52 that extends completely through the skirt 26 and renders most of its interior a void. One polymer suitable for the skirt 26 is a microcellular polyurethane. The skirt 26 is attached with an adhesive to the bottom surface 32 of the heel block 22 with its exterior surface 50 flush with the breast 34, side surfaces 36 and back surface 38 of the heel block 22. The cavity 52 is large enough to leave the bore 40 and the three guide bores 42 and 44 exposed through the skirt 26. Hence, the skirt 26 serves essentially to enclose the shock attenuation mechanism of the heel.

The top lift 24 includes a molded base 60 which is formed from a material that is more rigid than either the skirt 26 or the slug 28 and is reasonably resistant to wear, inasmuch as it comes against the surface over which the wearer walks, yet possesses a measure of flexibility. Rubber or polyurethane is suitable for this purpose. The base 60 has (FIGS. 2 and 3) a bottom surface 62 which is provided with ridges or some other pattern to enhance traction as well as a peripheral surface 64 and top surface 66. The peripheral surface 64 conforms to the exterior surface 50 of the skirt 26 and indeed the top surface 66 is attached with an adhesive to the bottom of the skirt 24 such that the peripheral surface 64 of the top lift 24 lies flush with the exterior surface 50 of the skirt 26.

In addition to the molded base 60, the top lift 24 includes (FIGS. 2–4) two front stabilizing pins 70 and a single rear stabilizing pin 72, each of which is firmly secured in the base 60 and projects upwardly from the base 60 perpendicular to its top surface 66. The pins 70 and 72, which lie parallel to each other, are preferably molded from a polymer which is somewhat flexible, but more rigid than the polymer of the base 60. The front pins 70 align with and are received in front guide bores 42, whereas the rear pin 72 aligns with and is received in the rear guide bore 44. The stabilizing pins 70 and 72 allow the top lift 24 to move toward and away from the heel block 22, but prevent it from rotating under the heel block 22. As a consequence, the peripheral surface 64 of the top lift 24 remains in registration with the peripheral surface 64 of the skirt 26 and with the breast 34, side surfaces 36 and back surface 38 of the heel block 22.

Each stabilizing pin 70 and 72 has a foot 74, the diameter of which is larger than the diameter of bore 42 or 44 into which the pin 70 or 72 fits. The foot 74 rises out of the top lift 24, extending above the top surface 66 of the top lift 24 a distance that is less than one-half the thickness of the skirt 26 when it is unrestrained and more closely approaching one-third the thickness of the skirt 26. At its lower end the foot 74 has a flange 76 which is embedded in the molded base 60. In addition to its foot 74, each pin 70 and 72 has a shank 78 which rises from the foot 74. The shank 78 possesses a uniform diameter, and that diameter is slightly less than the diameter of the guide bores 42, 44. Indeed, the shanks 78 for the pins 70 and 72 project into their respective guide bores 42 and 44 and when the skirt 26 is not deformed, they rise to the shoulders 48 at the upper ends of the bores 42 and 44. At the upper end of its shank 78 each guide pin 70 and 72 has a head 80 which is larger in diameter than the bore 42 or 44 through which the shank 78 extends, but smaller in diameter than the counterbore 46 into which the bore 42 or 44 opens. The head 80 projects at a right angle over the shoulder 48 where the bore 42 or 44 opens into the counterbore 46, and prevents the pin 70 or 72 from being withdrawn from the bore 42 or 44. Each head 80 has a beveled leading surface 82 and an axially directed slot 84 which extends well into the shank 78. This enables the head 80 and the shank 78 to contract, which facilitates assembly of the heel 20.

Indeed, during assembly, the heads 80 of the pins 70 and 72 are aligned with the respective bores 42 and 44 for those pins 70 and 72, and the entire top lift 24 is forced toward the heel block 22. The heads 80 contract and pass through the bores 42 and 44. Once the heads 80 enter the counterbores 46 at the upper ends of those bores 42 and 44, they snap outwardly, thus locking the pins 70 and 72 in their respective bores 42 and 44. More or less guide pins 70 and 72 may be used. For example, only a single guide pin 70 may be located ahead of the bore 40.

Figure 3:
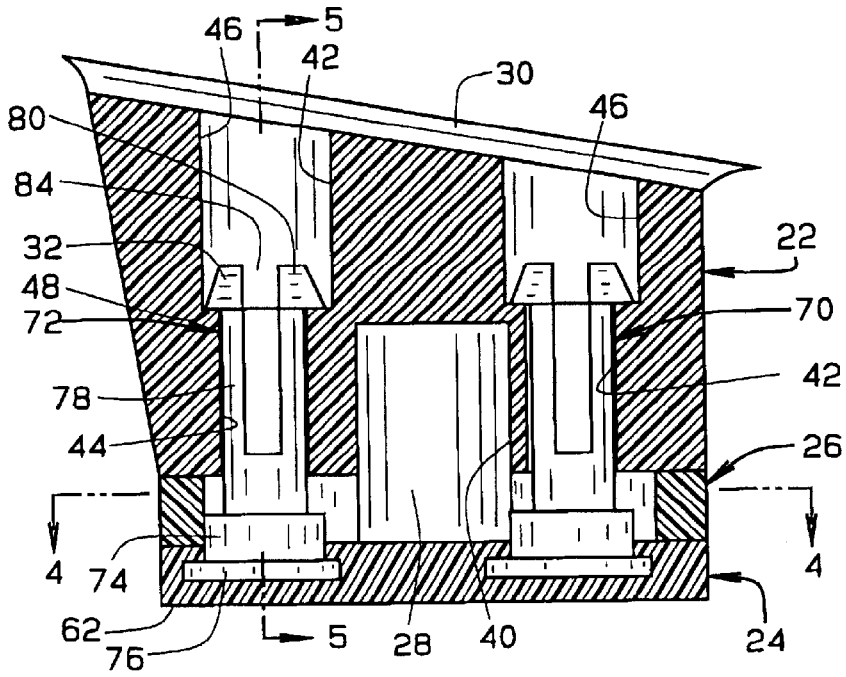
FIG. 3 is a sectional view taken along line 3—3 of FIG. 1.

The slug 28 fits into the bore 40 of the heel block 22 where its upper end bears against the closed end of the bore 40 (FIG. 3). The slug 28 projects downwardly out of the bore 40 and through the cavity 52 in the skirt 26. Its lower end bears against the top surface 66 of the base 60 for the top lift 24. Preferably the slug 28 is about 0.75 in. long and when unstressed it extends 0.25 in +/−0.010 in. between the bottom surface 32 of the heel block 22 and the top surface 66 of the top lift 24. The diameter of the slug 28 when unstressed is only slightly smaller than the diameter of the bore 40. Preferably the bore 40 has a diameter of 0.500 in. +0.020 in., −0.000 in., while the slug 28, when unstressed, has a diameter of 0.480 in. +0.000 in. −0.020 in., leaving a clearance of 0.020 in. to 0.060 in.

However, the slug 28 may range in diameter from about 0.44 inches to about 0.56 inches which translates into cross-sectional areas ranging from about 0.15 $in^2$ to about 0.25 $in^2$, should the slug be other than cylindrical. Of course, the bore 40 should conform in cross-sectional configuration to the slug, yet should be slightly larger. Moreover, the cross-sectional area of the slug 28 should be between about 7% and about 12% of the cross-sectional area of the bottom surface 60 on the top lift 24. The rear most surface area on the cavity 40 should be set to at least 0.60 inches ahead of the rearmost portion of the back surface 38 of the heel block 22 and its forwardmost surface area should be set about 0.62 inches to about 0.68 inches behind the breast 34 of the heel block 22, with the dimensions being along the bottom surface 32. The lateral most surface areas on the slug 28 should be set inwardly from the side surface 36 of the heel block 22, with the dimensions again being taken at the bottom surface 32.

The slug 28 is formed from a material which is reasonably firm, yet has the capacity to deform elastically under a force. Thus, while the slug 28 supports the heel block 22 over the top lift 24 and thereby transfers the weight of the wearer to the top lift 24, it has the capacity to yield somewhat so that impacts are absorbed by it. The slug 28 yields under a compressive force and in so doing expands into the cavity 52 where it remains unconfined laterally and also expands in the bore 40 as well. Elastomers are suitable for the slug 28, polyurethane being particularly well suited.

In use, the wearer of the shoe A walks over pavement or some other surface with the usual stride and with each step the top lift 24 of the heel 20 first contacts the pavement and then the forepart of the sole 14. Indeed, the rear most portion of the top lift 24 initially contacts the pavement and flexes slightly behind the slug 28, and this to a measure absorbs some of the impact. But the top lift 24 then comes down flat against the pavement, the wearer's weight is transferred to the heel block 22 and through the slug 28 to the top lift 24. While the descent of the top lift 24 abruptly ends, the heel block 22 continues downwardly owing to the elastic deformation of the slug 28 which in effect lies between the heel block 22 and the top lift 24. As the slug 28 is compressed axially, it offers progressively more resistance to the compression and after about 0.20 to 0.23 inches of compression it supports the wearer without significant further deformation. As the slug 28 compresses it deforms into the cavity 52 of the skirt 24 and also in the bore 40 in which the slug 28 is located. The skirt 24 also deforms, but offers little support for the heel block 22, since the material from which it is formed is considerably more resilient than the elastomer from which the slug 28 is formed. Extremely heavy forces bring the bottom surface 32 of the heel block 22 to the feet 74 on the pins 70 and 72, and the feet 74 prevent further descent of the heel block 22.

As the slug 28 compresses, the stabilizing pins 70 and 72 slide further into their respective guides bores 42 and 44, but offer essentially no resistance to the descent of the heel block 22 toward the top lift 24. The pins 70 and 72 also prevent the top lift 24 from rotating relative to the heel block 22, so that when the wearer turns or pivots the shoe A, the top lift 24 follows heel block 22. The pins 70 and 72 further add a measure of stability to the top lift 24 in that they rigidify it longitudinally and laterally and thereby retard significant rocking sideways or forwardly and backwardly beneath the heel block 22, this being by reason of the generally rigid coupling between the feet 74 of the pins 70 and 72 and the base 60 of the top lift 24. In this way, the pins 70 and 72 compensate for the relatively little lateral and longitudinal support provided by the skirt 26.

This invention is intended to cover all changes and modifications of the example of the invention herein chosen for purposes of the disclosure which do not constitute departures from the spirit and scope of the invention.

What is claimed is:

1. A heel for a shoe, said heel comprising:

a heel block having a bottom surface that is presented downwardly and a cavity and a plurality of guide holes which are discrete from, and surround, said cavity; said cavity and guide holes having separate openings out of the bottom surface, the cavity being set inwardly from the periphery of the heel block so that it is completely surrounded by the heel block and having an end surface that is presented downwardly;

a top lift having a base that is located below the bottom surface of the heel block such that a space exists between the base and the bottom surface of the heel block, the top lift having a plurality of guide pins which project upwardly from the base into the guide holes in the heel block, the pins being narrow enough to slide upwardly and downwardly in the guide holes; and a resilient member located within the cavity in the heel block and having its upper end at the upper surface of the cavity and its lower end at the base of the top lift, the separate cavity and guide bores maintaining a spacing between the slug and the guide pins; the resilient member being formed from a material that is resilient, yet stiff enough to support the heel block with its bottom surface located above the top lift, the cross-sectional area of the slug in the cavity being between about 7% and about 12% of the area of the top lift.

2. A heel according to claim 1 wherein the resilient member is formed from an elastomer and is firm enough to support the heel block with its bottom surface spaced from the base of the top lift when an individual's weight is supported on the heel.

3. A heel according to claim 1 in which the resilient member projects through the space between the bottom surface of the heel block and the top of the base for the top lift.

4. A heel according to claim 3 wherein the resilient member bears against the upper surface of the cavity and also against the base of the top lift.

5. A heel according to claim 3 wherein the cavity is a bore having a closed upper end which forms the upper surface of the cavity.

6. A heel according to claim 3 and further comprising a skirt located in the space between the bottom surface of the heel block and the base of the top lift.

7. A heel according to claim 6 wherein the heel block at its lower end, the skirt, and the base of the top lift have their peripheries generally in registration.

8. A heel according to claim 1 wherein said plurality of pins comprises two pins located in front of the resilient member and another pin located behind the resilient member.

9. A heel according to claim 8 wherein the pins have enlarged feet which are embedded within the base.

10. In combination with a shoe upper and a heel seat on the upper, a heel extending downwardly from the heel seat and having the capacity to attenuate impacts, said heel comprising:

a rigid heel block attached to the heel seat and having front, back and side surfaces as well as a bottom surface that is presented downwardly, the heel block containing guide bores and a cavity separate from and surrounded by the bores, the cavity opening out of the bottom surface of the heel block generally, midway between the front and back surfaces of the heel block and being set inwardly from the front, side and back surfaces, the cavity having an upper end in the heel block, the guide bores also opening out of the bottom surface of the heel block; the guide bore openings being separate from the cavity opening;

a top lift attached to the heel block, the top lift including a base that lies below the bottom surface of the heel block, with a space being between the bottom surface and the top lift, the top lift also including guide pins which project upwardly from the base and into the guide bores where they slide easily in the bores;

a slug located in the cavity and projecting into the space between the bottom surface of the heel block and the base of the top lift, the slug being spaced from the guide pins, the cross-sectioned area of the slug in the cavity being between about 7% and about 12% of the cross-sectional area of the top lift, the slug at its bearing against the upper end of the bore and at its lower end being against the top lift, the slug being formed from a resilient material and being firm enough to support the heel block above the base of the top lift under the weight of the wearer of the shoe, whereby the slug has the capacity to transfer the weight of the wearer to the base of the top lift, the slug further being resilient enough to attenuate impacts when abruptly applied forces are transferred through it; and a resilient skirt located in the space between the bottom surface of the heel block and the base of the top lift, the skirt being formed from a material having greater resiliency than the slug.

11. The combination according to claim 10 wherein the skirt has an outwardly presented surface which is flush with the front, back and side surfaces of the heel block.

12. The combination according to claim 10 wherein at least one bore is in front of the cavity and another bore is behind the cavity.

13. The combination according to claim 10 where two bores are located in front of the cavity and another bore is behind the cavity.

14. The combination according to claim 10 wherein the slug is formed from an elastomer.

15. The combination according to claim 10 wherein the pins have feet which are greater in diameter than the bores and rise above the base of the top lift, but normally not to the bottom surface of the heel block.

16. The combination according to claim 10 wherein the pins have heads which lie above the bores and engage the heel block to prevent withdrawal of the pins from the bores.

17. The combination according to claim 10 wherein the heel block contains counterbores into which the bores open; and wherein the pins have heads that are located in the counterbores and are capable of contracting to a size small enough to fit through the bores and then expanding in the counterbores to prevent withdrawal of the pins from the bores, so the top lift does not become detached from the heel block.

18. The combination according to claim 17 wherein the base of the top lift is molded from rubber or a polymer and the pin is formed from a polymer and has an enlarged foot which is embedded in the base.

19. A heel for a shoe, said heel comprising:

a heel block having front, back and side surfaces as well as a bottom surface that is presented downwardly, the heel block also having a cavity that opens out of the bottom surface at least 0.6 inches ahead of the rearmost portion of the back surface, the cavity terminating within the heel block where the cavity has an upper end, the heel block also having guide holes that are separate from and surround the cavity and open out of the bottom surface; the guide hole openings being separate from the cavity opening:

a top lift having a base that is located below and spaced from the bottom surface of the heel block, the top lift having stabilizing pins attached to its base and projecting upwardly from the base into the guide holes in the heel block, the pins being narrow enough to slide upwardly and downwardly in the guide holes;

a slug located in the cavity in the heel block and having an upper end against the upper end of the cavity and a lower end against the base of the top lift, the slug being spaced from the guide pins the slug being smaller in cross section than the bottom surface of the heel block and being set inwardly from the front, back and side surfaces of the heel block, the slug being formed from an elastomer that is resilient and will compress when subjected to impacts imparted by walking and is stiff enough to support the heel block with its bottom surface located above the top lift; and a skirt located between the bottom surface of the heel block and top lift at the front, side, and back surfaces of the heel block.

20. A heel according to claim 19 wherein the cavity opens out of the bottom surface of the heel block generally midway between the front and back surfaces of the heel block.

21. A heel according to claim 19 wherein the guide holes have an enlarged region spaced form the bottom surface, and the pin s have heads that are capable of contracting to a size small enough to fit through the holes and then expand in the enlarged region to prevent withdraw of the top lift from the heel block.

22. A heel according to claim 21 wherein the base of the top lift is molded from rubber or a polymer, and the pins are formed from a polymer and have feet which are embedded in the base.

23. A heel for a shoe, said heel comprising: a a heel block having front, back and side surfaces as well as a bottom surface that is presented downwardly, the heel block also having a cavity that opens out of the bottom surface generally midway between the front and back surfaces and is substantially smaller in horizontal cross section than the area of the bottom surface, the cavity terminating within the heel block where it has an upper end, the heel block further having a single guide bore between the cavity and the back surface and two guide bores between the front surface and the cavity, all of the guide bores being parallel to each other and opening out of the bottom surface of the heel block, the guide bores separated from the cavity, the heel block further having counterbores into which the guide bores open;

a top lift having a base that is located below, yet spaced from, the bottom surface of the heel block and having a peripheral surface, the top lift also having stabilizing pins which project from the base into the guide bores and have enlarged heads which are located in the counterbores to prevent the stabilizing pins from being withdrawn from the guide bores and the top lift from being detached from the heel block; and a skirt located between the bottom surface of the heel block and base of the top lift and having an exterior surface which is flush with the front, back and side surfaces of the heel block and with the peripheral surface of the top lift.

24. A heel according to claim 23 wherein the enlarged heads of the stabilizing pins are capable of contracting to a width small enough to pass through the bores.

25. A heel according to claim 23 wherein the stabilizing pins have enlarged feet which are embedded in the base and are formed from a polymer.

26. A heel for a shoe, said heel comprising:

a heel block having front, back, side, and bottom surfaces, a cavity that opens out of the bottom surface and terminates within the heel block where the cavity has an upper end, at least two guide holes that are separate from and surround the cavity and open out of the bottom surface; the guide hole openings being separate from the cavity opening;

a top lift having a base that is located below and spaced from the bottom surface of the heel block, the top lift having stabilizing pins attached to its base and projecting upwardly from the base into the guide holes in the heel block, the pins being sized to allow for the heel block to move axially relative to the guide pins;

a resilient member located in the cavity in the heel block and having an upper end against the upper end of the cavity and a lower end against the base of the top lift; the resilient member having a length greater than the cavity; and a skirt located between the bottom surface of the heel block and top lift at the front, side, and back surfaces of the heel block; said skirt encasing portions of said resilient member and guide pins located between said heel block and top lift; said resilient member and guide pins being spaced from each other within the space enclosed by said skirt.

* * * * *